US005930921A

United States Patent [19]

Sorofman et al.

[11] Patent Number: 5,930,921

[45] Date of Patent: Aug. 3, 1999

[54] ILLUMINATED SHOE

[75] Inventors: Howard Sorofman; Robert J. Armey, both of St. Louis County, Mo.

[73] Assignee: Brown Group, Inc., St. Louis, Mo.

[21] Appl. No.: 09/025,619

[22] Filed: Feb. 18, 1998

[51] Int. Cl.[6] ..... A43B 23/00; F21L 15/08

[52] U.S. Cl. ..... 36/137; 362/103; 362/276

[58] Field of Search ..... 36/136, 137; 362/103, 362/276, 191

[56] References Cited

U.S. PATENT DOCUMENTS

| | | | |
|---|---|---|---|
| 1,184,396 | 5/1916 | Trimble | 36/137 |
| 4,130,951 | 12/1978 | Powell . | |
| 4,332,007 | 5/1982 | Gibstein et al. | 362/103 |
| 4,438,482 | 3/1984 | Leon et al. . | |
| 4,451,871 | 5/1984 | Kirkley et al. | 362/103 |
| 4,848,009 | 7/1989 | Rodgers . | |
| 5,149,489 | 9/1992 | Crews . | |
| 5,193,896 | 3/1993 | Oberlander | 362/103 |
| 5,235,761 | 8/1993 | Chang | 36/137 |
| 5,237,760 | 8/1993 | Altman et al. | 36/137 |
| 5,357,697 | 10/1994 | Lin | 36/137 |
| 5,359,790 | 11/1994 | Iverson et al. | 36/136 |
| 5,371,662 | 12/1994 | Shen-Ko | 36/137 |
| 5,394,312 | 2/1995 | Bland . | |
| 5,396,720 | 3/1995 | Hwang et al. | 36/137 |
| 5,456,032 | 10/1995 | Matsumoto et al. | 362/103 |
| 5,463,537 | 10/1995 | Trattner et al. | 36/137 |
| 5,469,342 | 11/1995 | Chien . | |
| 5,577,828 | 11/1996 | Nadel et al. | 36/137 |
| 5,599,088 | 2/1997 | Chien | 36/137 |
| 5,604,999 | 2/1997 | Barker . | |
| 5,644,858 | 7/1997 | Bemis . | |
| 5,673,499 | 10/1997 | Attilieni | 36/137 |
| 5,812,063 | 9/1998 | Weng et al. | 36/137 |
| 5,813,148 | 9/1998 | Guerra | 36/137 |

FOREIGN PATENT DOCUMENTS

| | | |
|---|---|---|
| 9527417 | 10/1995 | WIPO . |

*Primary Examiner*—M. D. Patterson

*Attorney, Agent, or Firm*—Polster, Lieder, Woodruff & Lucchesi, L.C.

[57] ABSTRACT

A shoe in the side of its upper or along its outsole has a transparent diffusing element with a convex front face and a multitude of facets in its back face. A pocket opens out of the back face and contains a light emitting diode which is connected to a energizing module in the outsole of the shoe. The circuit contains a switch which is sensitive to impacts, and a battery, and when the switch is subjected to an impact of sufficient magnitude, the circuit impresses across the diode an electrical potential that is derived from the battery. The electrical potential illuminates the diode and the illumination spreads through the diffusing element, reflecting off the facets of its back face so that the diffusing element illuminates large areas on the shoe.

24 Claims, 3 Drawing Sheets

ILLUMINATED SHOE

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

This invention relates in general to footwear, and more particularly, to a shoe containing illumination and also an outsole containing illumination.

Children have taken a liking to shoes having illumination of one type or another incorporated into them. Typically, the shoe contains a light emitting diodes (LED) in its upper or along its sole and a battery and energizing circuitry in its heel. When the child, while walking or running, steps on the heel, the circuitry momentarily impresses an electrical potential across the LED and it illuminates it. Where the shoe contains multiple LEDs, the circuitry may illuminate them in a predetermined sequence. To a measure, the illuminated shoe represents a novelty, but when worn at night, it makes the child more visible, and thus provides the child with a measure of safety.

But an LED does not emit much light, and the light which it does emit is highly concentrated. Thus, a shoe having multiple LEDs appears to have points of light, but not wide regions of illumination.

BRIEF SUMMARY OF THE INVENTION

The present invention resides in a shoe having relatively small and concentrated sources of light and diffusing elements at those sources for spreading the light over greater areas. The invention also consists in the parts and in the arrangements and combinations of parts hereinafter described and claimed

BRIEF DESCRIPTION OF THE SEVERAL VIEWS OF THE DRAWINGS

In the accompanying drawings which form part of the specification and wherein like numerals and letters refer to like parts wherever they occur.

DETAILED DESCRIPTION OF THE INVENTION

Figure 1:
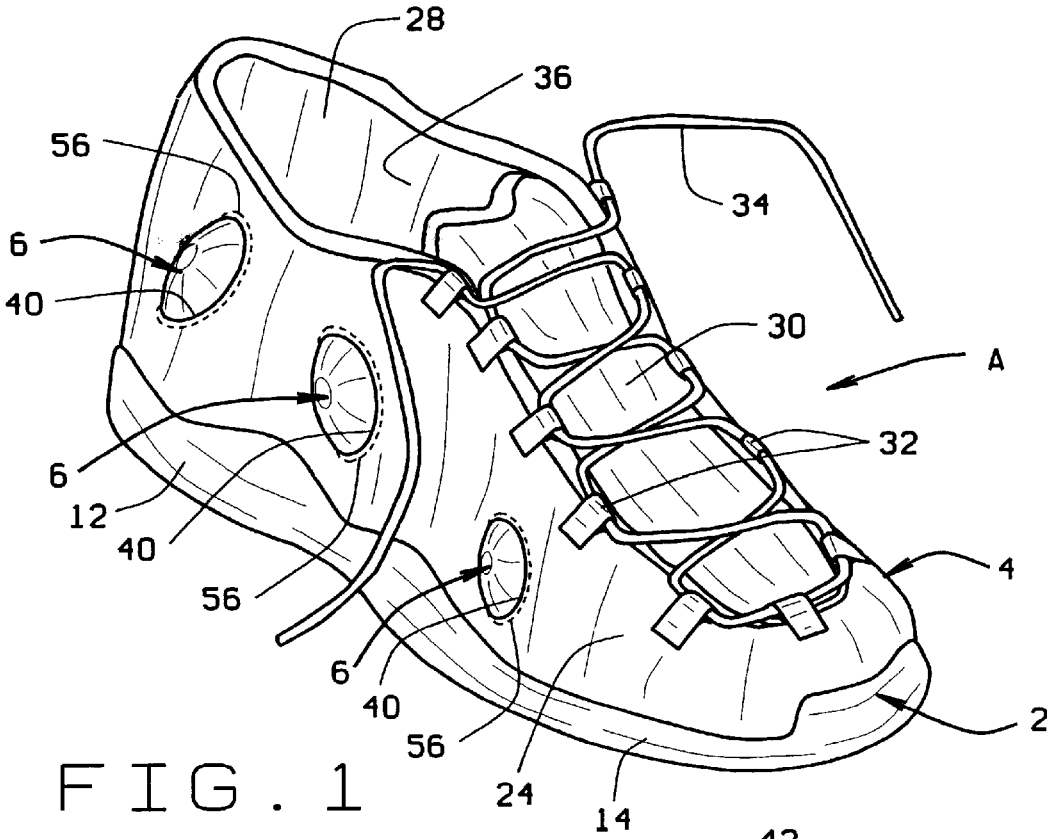
FIG. 1 is a perspective view showing the toe and one side of an illuminated shoe constructed in accordance with and embodying the present invention.

Referring now to the drawings, a shoe A (FIGS. 1 and 2) has an outsole 2 and a upper 4 which is attached to the outsole 2, it being configured to receive and fit over the user's foot. The upper 4 has several illuminating devices 6 installed on it, and these devices momentarily cast illumination when the shoe A is subject to an impact, such as when the user brings the outsole 2 into contact with pavement or a floor. The illuminating devices 6 project outwardly from the side of the upper 4, and when illuminated are highly visible. Indeed, they are not only visible when viewed from directly on, but also when viewed at a considerable angle.

Figure 2:
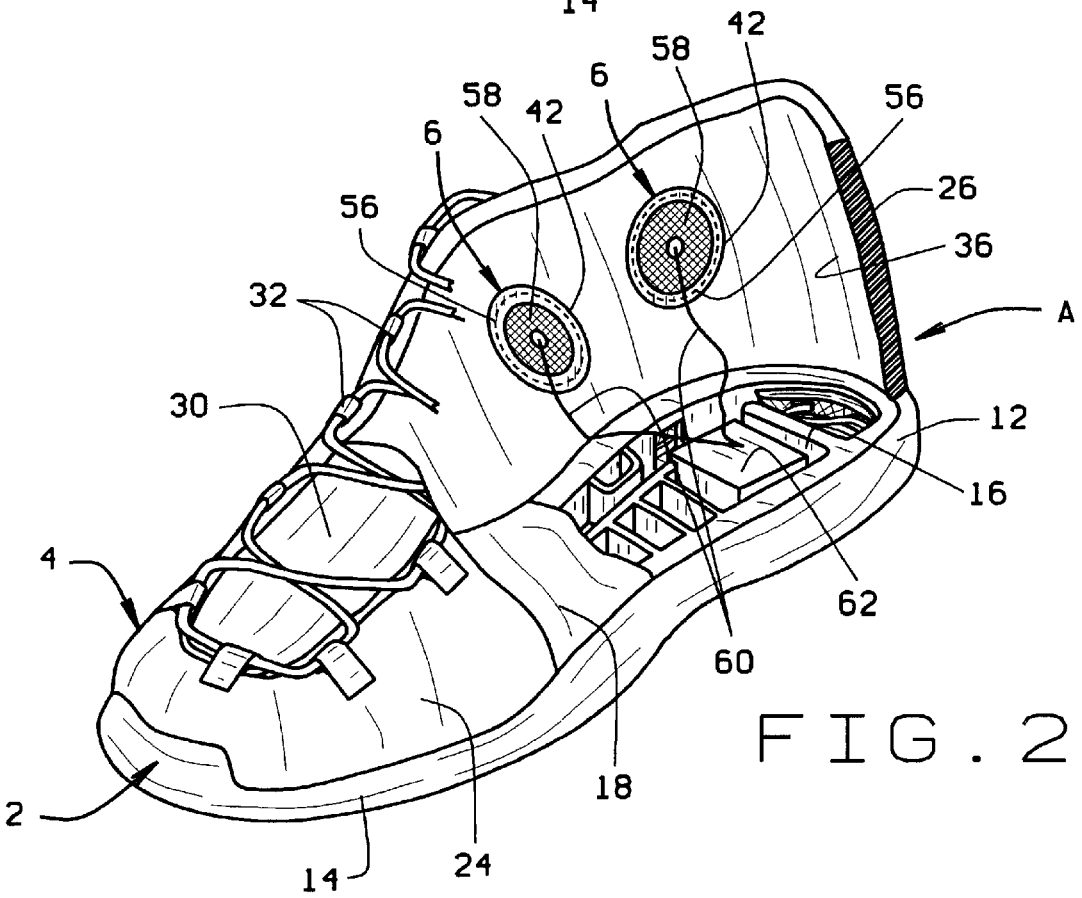
FIG. 2 is a perspective view showing the toe and the opposite side of the illuminated shoe, with the shoe upper being partially broken away to show the interior of the shoe.
Figure 3:
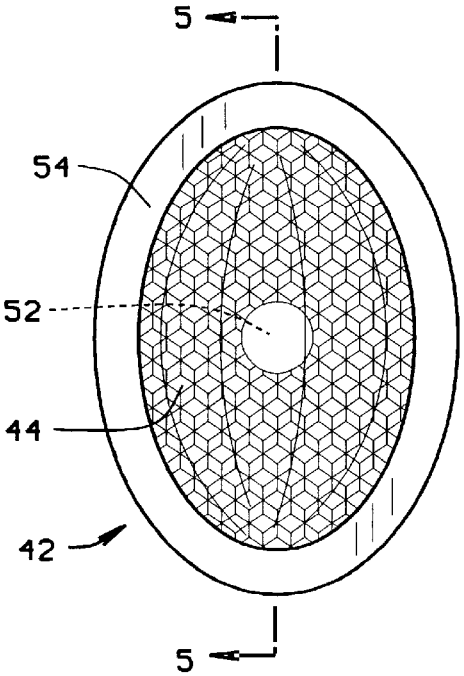
FIG. 3 is a front elevational view of a diffusing element forming part of the present invention.
Figure 4:
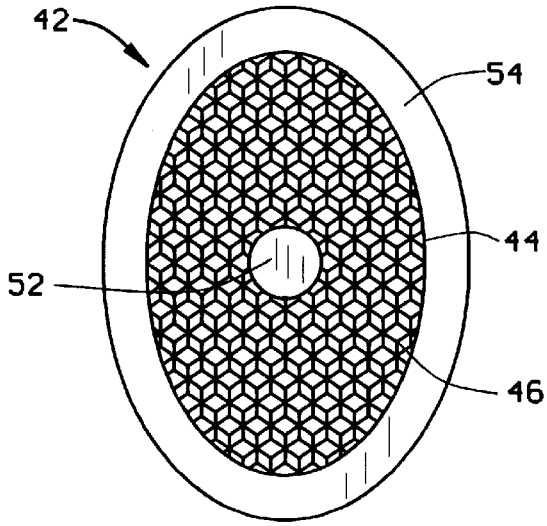
FIG. 4 is a rear elevational view of the diffusing element.
Figure 5:
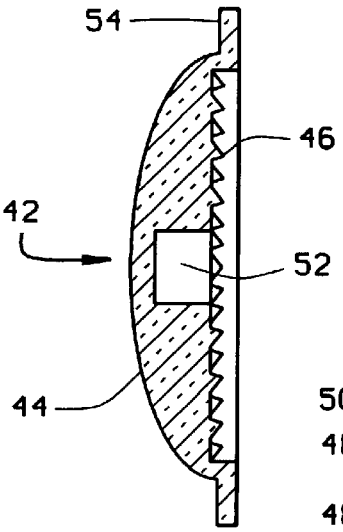
FIG. 5 is a sectional view of the diffusing element taken along line 5—5 of FIG. 3.

The outsole 2 is molded from an elastomer which gives it a good measure of flexibility and some resilience, yet enough stiffness to support the user without significant deformation. It includes a heel portion 12, which underlies the user's heel, and a foreportion 14 which underlies the rest of the user's foot, that is the toes, ball and arch. The heel portion 12 contains a cavity 16 (FIG. 2).

The outsole 2 has an insole 18 (FIG. 2) attached to it. Indeed, the insole 18 covers substantially the entire outsole 2 and provides the surface on which the user's foot actually rests. The insole 18 also covers and completely closes the cavity 16 in the heel portion 12 of the outsole 2.

The upper 4 has (FIGS. 1 and 2) a vamp 24 which extends over the foreportion 14 of the outsole 2 and quarters 26 which extend along the heel portion 12 and forwardly to merge with the vamp 24. The quarters 26 create an opening 28 which receives the user's foot, and that opening 28 extends forwardly into the vamp 24 where it is occupied by a tongue 30. Along the opening 28 the vamp 24 is provided with eyelets 32 through which a lace 34 passes. Finally, the upper 4 contains a liner 36 which lies along the inside surfaces of the vamp 24 and quarters 26, being attached to them. The vamp 24 and quarters 26 may be cut from leather or canvas, whereas the liner 36 is normally cut from cloth.

The upper 4 contains apertures 40 (FIG. 1) in those panels of the vamp 24 and the quarters 26 that are presented outwardly, that is in the region of the vamp 24 and the quarter 26 that lie along the outside of the user's foot. The liner 36 lies behind each of the apertures 40, so the interior of the shoe A is not exposed through the openings 40. The openings 40 may be elliptical, as illustrated, or other configurations such as circular, polygonal, or starshaped or they may be simply elongated, either straight or angular (dog legged). The illuminating devices 6 fit into the opening 40 and generally conform in shape to them. The devices 6 project outwardly from the openings 40 and for the most part lie beyond the outside surface of the upper 4.

Figure 6:
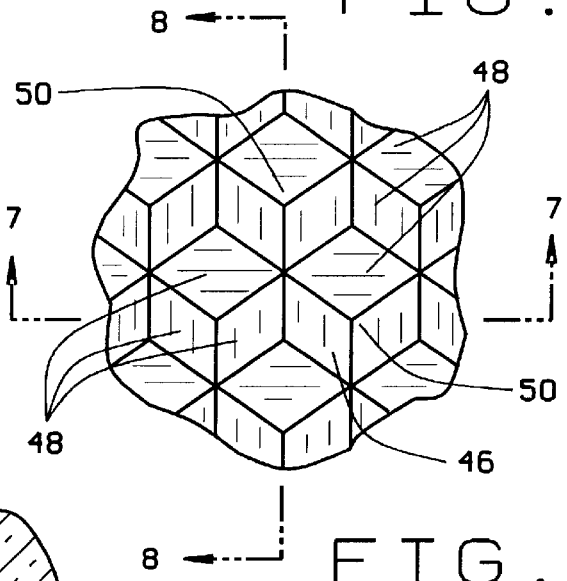
FIG. 6 is an enlarged fragmentary view of the back face of the diffusing element.
Figure 8:
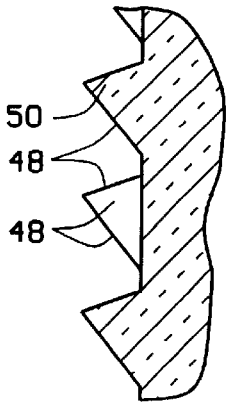
FIG. 8 is a sectional view taken along line 8—8 of FIG. 6.
Figure 7:
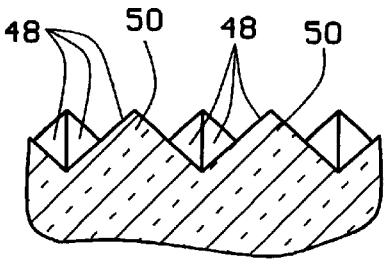
FIG. 7 is a sectional view taken along line 7—7 of FIG. 6.
Figure 9:
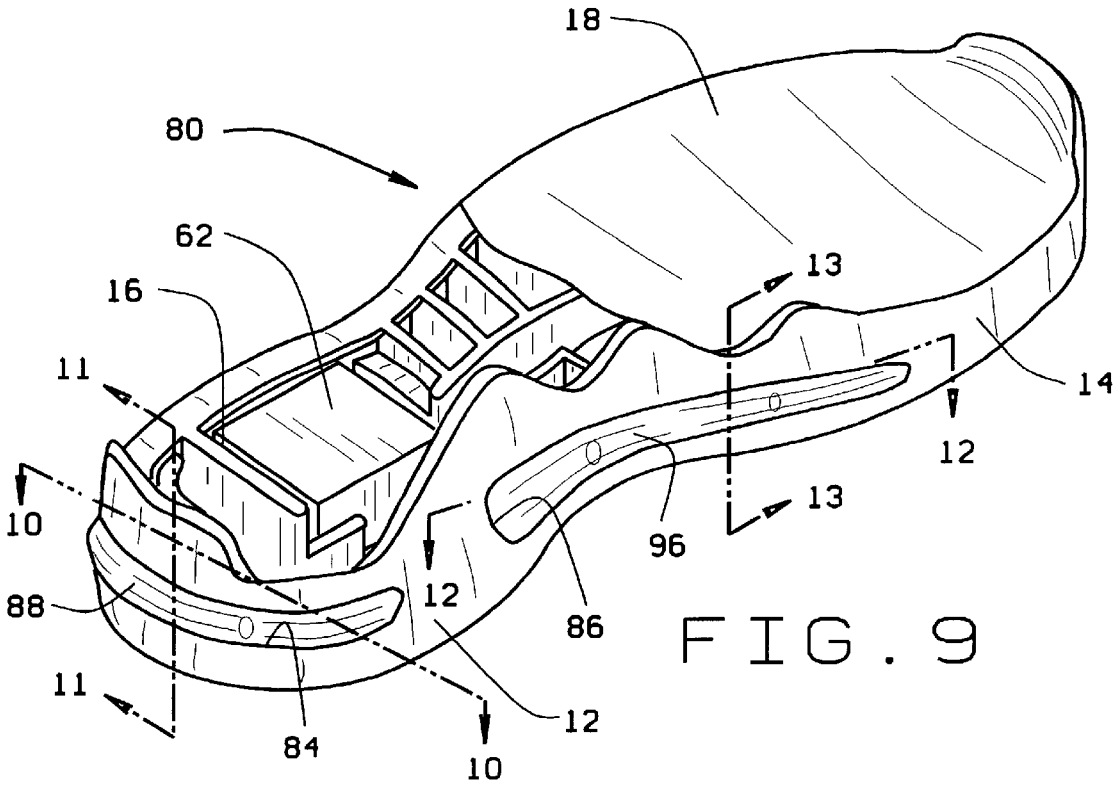
FIG. 9 is a perspective view of a modified outsole which is provided with diffusing elements in accordance with the present invention.
Figure 10:
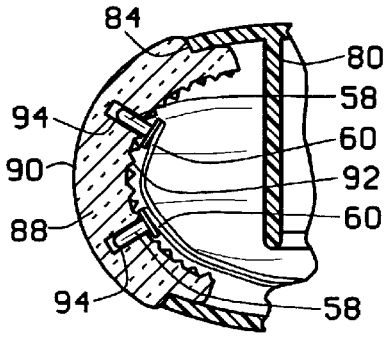
FIG. 10 is a sectional view taken along line 10—10 of FIG. 9.
Figure 11:
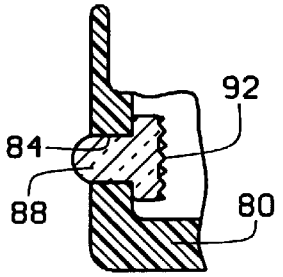
FIG. 11 is a sectional view taken along line 11—11 of FIG. 9.
Figure 12:
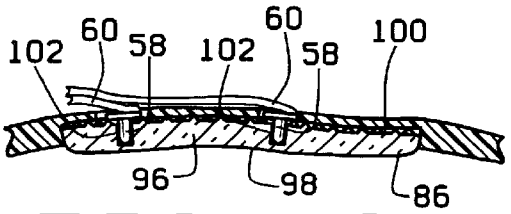
FIG. 12 is a sectional view taken along line 12—12 of FIG. 9.
Figure 13:
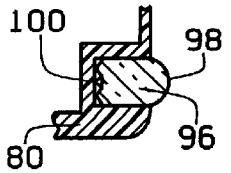
FIG. 13 is a sectional view taken along line 13—13 of FIG. 9.

Each illuminating device 6 includes a diffusing element 42 (FIGS. 3–8) which is formed from a transparent material, preferably a polymer having a measure resilience and flexibility and being soft enough to be penetrated by a sewing needle in its thinner cross-sections. It has a dome-shaped front face 44 and a generally flat back face 46 over which the liner 36 passes. The front face 44 is smooth, although convex. The back face 46 is generally flat in the sense that as a whole it lies within a plane, but it is not planar in the sense that a conventional mirror is. Indeed it contains a multitude of small facets 48 (FIGS. 6–8) which create an array of small pyramidal shapes or projections 50 that are arranged in rows extending across the face 46. Each projection 50 is formed from three facets 48 which intersect. The projections 50 are staggered, so that the projections 50 of one row are offset from the projections 50 in the rows that lie immediately adjacent to that one row. The projections 50 impart a textured—indeed, a faceted appearance—to the back face, and this textured or faceted appearance is clearly visible through the front face 44 which, being convex, tends to magnify the textured back face 46. The front face 44 and the back face 46 are essentially the same size and have the same peripheral configuration, so that the textured appearance of the back face 46 is visible in essentially every region of the front face 44. Actually, the projections 50 occupy almost the entire back face 46, except for the very center of it. Here the diffusing element 42 has a pocket 52 which extends from the back face 46 deep into the element 42, but terminates short of the front face 44. The element 42 bears no pattern between the bottom of the pocket 52 and the dome-shaped front face 44, so that the pocket 52 is clearly visible through the front face 42. Thus, the pocket 52 opens out of the diffusing element 42 through the back face 44.

The apertures 40 in the upper 4 conform to the peripheral configurations of the front faces 44 on the diffusing elements 42. But the diffusing elements 42 themselves are larger. Each diffusing element 42 along the periphery of its front face 44 has a flange 54 which is considerably thinner than the space between the front and back faces 44 and 46, and this holds true even though the back face 46 is recessed with respect to the flange 54. Being quite thin, the flange 54 is considerably more flexible than the remainder of the diffusing element 42, that is the portion between the front and back faces 44 and 46.

The diffusing element 42 fits into its aperture 40 in the upper 4 with its dome-shaped front face 44 projecting through the aperture 40 and the flange 54 lying behind the upper 4, yet in front of the liner 36 (FIGS. 1 and 2). The diffusing element 42 is attached to the upper 4 by stitches 56 which follow the periphery of the aperture 40 and pass through the flange 54. Since the back face 46 is recessed somewhat with respect to the flange 54, it is offset slightly beyond the exterior surface of the upper 4. The liner 36 extends behind and the back face 46 and obscures it.

In addition to the diffusing element 42, each illuminating device 6 includes a light source in the form of a light emitting diode (LED) 58 which fits into the pocket 52 of the element 42 where it is captured by the liner 36 which extends over the back face 46 of the element 42. The LED 58 has wires 60 connected to it, and the wires 58 lead to the cavity 16 in the outsole 2 (FIG. 2), passing between the upper 4 and the liner 36, so that they remain isolated from the user's foot.

The cavity 16 within the heel portion 12 of the outsole 2 contains a modular energizing unit 62 for momentarily impressing an electrical potential across the wires 60 of each of several LEDs 58, either in unison or sequentially, so that the LEDs 58 are illuminated. This potential and the electrical current, which flows through the LEDs as a consequence, derive from a small battery which forms part of the energizing unit 62. In addition, the energizing unit 62 has electrical circuitry that includes a motion-sensitive switch. The switch 68 may constitute nothing more than a small coil spring of numerous convolutions which is fastened firmly at one end and projects horizontally in a cantilevered manner over a contact plate, from which it is normally separated. However, when the spring is subjected to a vertically directed force, such as would derive from a walking or running impact imparted to the module, the spring is deflected against the contact. When this occurs, the circuitry momentarily places the LEDs 56 across an electrical potential that is ultimately derived from the battery. The potential cause current to pass through each LED 58 and illuminate it. The circuitry in the energizing unit 62 may correspond to the circuitry disclosed in U.S. Pat. No. 5,848,009 issued to Nicholas A. Rogers on Jul. 18, 1989.

In use, the very act of walking subjects the heel portion 12 of the outsole 2 to impacts indeed, impacts which produce vertically directed forces of a magnitude great enough to close the switch of the energizing unit 62. The circuitry momentarily impresses on each LED 58 an electrical potential of sufficient magnitude to illuminate the LED 58. Each LED 58 emits a momentary burst of light, either concurrent with another or all of the other LEDs 58 or sequentially with the other LEDs 58, depending on how the circuitry is configured.

At each diffusing element 42, the burst of illumination from the LED 58 at that element is immediately visible at the end of the pocket 52 in which the LED 58 resides. After all, each element 42 is fully transparent immediately beyond the bottom of its pocket 52. The illumination from the LED 58 also spreads laterally through the diffusing element 42. Here it is reflected and refracted from the many facets 48 that form the pyramidal projections 50 in the back face 46 of the element 42. As a consequence, illumination emits from the array of pyramidal projections 50, and the entire diffusing element 42 is illuminated.

Each diffusing element 42, when viewed head on with its LED 58 illuminated, is highly visible, not only in the region of its pocket 52 where its LED 58 is located, but also through the surrounding region that lies in front of the textured back face 46. Being domedshaped on its front face 44, the diffusing element 42 projects somewhat beyond the side of the shoe upper 4, and as a consequence, the diffusing element 42 is visible when observed obliquely or even from directly behind or in front of the shoe A. In this instance, the LED 58 itself and the illumination emitted by it is visible directly through the transparent portion of the refractive element 42. So are the pyramidal projections 50 that form the textured back face 46, so the illumination which is reflected and refracted by them is likewise visible. Again, the entire diffusing element 42 appears to be and is illuminated.

The illuminating devices 6 need not be confined to the upper 4 of the shoe A, but may be located along any exposed surface of the shoe A. This includes the side and end surfaces of the outsole.

A modified outsole 80 (FIGS. 9–13) is similar to the outsole 2 in that it has a heel portion 12, a foreportion 14 and a cavity 16 located within the heel portion 12. An upper (not shown) is attached to the outsole 80, and it is similar to the upper 4, although perhaps lacking the apertures 40 and the illuminating devices 6. Also, the outsole 80 has an insole 18 extended over it to cover the cavity 16 and to provide a surface against which the user's foot bears. But the outsole 80 differs from the outsole 2 in that it has an elongated opening 84 located in its heel portion 12 and an even longer elongated opening 86 located along its side which faces away from the user, with that opening 86 extending from the heel portion 12 into the foreportion 14.

The rear opening 84 contains a diffusing element 88 (FIGS. 10 and 11) which has a front face 90 (actually presented rearwardly on the outsole 80) and a back face 92. As in the diffusing element 42, the front face 90 is smooth and also convex, whereas the back face 92 is composed of a multitude of pyramidal projections 50 which give it a textured appearance. The element 88 contains two pockets 94 which open out off its back face 92, but terminate short of the front face 90. The pockets 94 are exposed to the cavity 16 in the outside 80. The rear diffusing element 88 is formed from a transparent material that possesses enough resiliency to yield with the remainder of the outsole 2. It is adhesively bonded to the outsole 2.

The side opening 86 contains another diffusing element 96 (FIGS. 12 and 13) having a front face 98 that is presented outwardly and exposed along the side of the outsole 80 and a back face 100 that is presented inwardly with a portion of it being exposed to the cavity 16. The front face 98 is smooth and convex, whereas the back face 100 is generally flat and textured in that is formed by a multitude of pyramidal projections 50. The side diffusing element 96 contains two pockets 102 which open out of its back face 100 and terminate short of its front face 98. The pockets 102 also open toward and are in communication with the heel cavity 16. The diffusing element 98 is formed from a transparent material which is resilient and possesses flexibility comparable to that of the outsole 2 itself. Well it should, for the side diffusing element 96 lies in the region of the outsole which undergoes considerable flexure when the user walks. The element 96 is adhesively bonded to the outsole 2.

The pockets 94 in the rear diffusing element 88 and the pockets 102 in the side diffusing element 96 receive LEDs 58 which in turn are connected to an energizing module 62 located in the cavity 16 of the outsole 80, the connections being through wires 60 that are confined entirely to the outsole 80. The LEDs 58 together with the diffusing elements 88 and 96 form illuminating devices that are along the rear and side of the outsole 80 and hence are visible at an exterior surface of the shoe of which the outsole 80 is a component.

When the outsole 80 is subjected to an impact, such as when it is brought against a floor or pavement during normal walking or running, the energizing module 62 momentarily impresses an electrical potential across the LEDs 58 in the diffusing elements 88 and 96, preferably sequentially. The illuminated LEDs 58 are visible through the transparent diffusing elements 88 and 96 where they form points of light. But the illumination emitted by the LEDs 58 also reflects off the facets 48 that form the pyramidal projections 50 on the back faces 72 and 100 of the two diffusing elements 88 and 96. As a consequence, the diffusing elements 88 and 96 reflect illumination from essentially their entire back faces 92 and 100, although not with the intensity of the points of light represented by the LEDs 58 themselves.

This invention is intended to cover all changes and modifications of the example of the invention herein chosen for purposes of the disclosure which do not constitute departures from the spirit and scope of the invention.

What is claimed is:

1. A shoe comprising: an outsole; an upper attached to the outsole and configured to cover a user's foot, the outsole and the upper together providing an exterior surface; a light diffusing element located along the exterior surface where it is exposed, the diffusing element being flexible and resilient and having a front face presented outwardly and exposed along the exterior surface and a back face presented away from the front face, the back face being characterized by a multitude of facets arranged at angles with respect to each other to create an array of pyramidal shapes that are organized into side-by-side rows; an electrically activated light source located at the diffusing element such that light emitted by it illuminates some of the facets and spreads the illumination emitted from the light source generally throughout the diffusing element, whereby much of the diffusing element is illuminated when the light source is energized; and a source of electrical energy connected to the light source for illuminating the light source under prescribed conditions.

2. A shoe according to claim 1 wherein the diffusing element contains a pocket which opens out of its back face but terminates short of the front face; and the light source is located in the pocket.

3. A shoe according to claim 2 wherein the front face of the diffusing element is convex and the pocket is located behind generally the highest region of the convex front surface.

4. A shoe according to claim 3 wherein the diffusing element is formed from a transparent material.

5. A shoe according to claim 2 wherein the source of electrical energy is located in the outsole.

6. A shoe according to claim 2 wherein the diffusing element and the light source are on the upper and a liner lies behind the upper and covers the back face of the diffusing element and the light source.

7. A shoe according to claim 6 wherein the diffusing element includes a flange which projects laterally beyond the front face and lies along the periphery of the element beyond the array of pyramidal shapes; and wherein the flange is captured between the upper and the liner and is attached to the upper with stitching which passes through the flange and the upper.

8. A shoe according to claim 7 wherein the back face of the diffusing element is offset from the flange and toward the front face.

9. A shoe according to claim 1 wherein the pyramidal shapes of any row are offset from the pyramidal shapes of the adjacent row or rows.

10. A shoe according to claim wherein the pyramidal shapes are projections that are directed away from the front face.

11. A shoe comprising: an outsole having a cavity; an upper attached to the outsole and configured to cover a user's foot; a light diffusing element located on the upper, the diffusing element being flexible and resilient and having a front face which projects beyond the upper and is smooth and a back face which is located generally along the upper and is presented away from the front face, the back face having a multitude of facets arranged at angles with respect to each other to create an array of pyramidal shapes that are organized into side-by-side rows; an electrically-energized light source located at the diffusing element such that the light emitted by the light source illuminates the diffusing element, whereby the light is spread throughout the diffusing element; and a source of electrical energy located in the cavity of the outsole and connected to the light source, whereby the diffusing element is illuminated when electrical energy from the source of electrical energy is impressed across the light source.

12. A shoe according to claim 11 wherein the upper includes a quarter and a vamp; wherein a liner that lies along the inside surfaces of the quarter and the vamp; wherein the quarter contains an aperture at which the diffusing element is located; and wherein the liner lies behind the quarter and extends over the back surface of the diffusing element.

13. A shoe according to claim 12 wherein the diffusing element is one of a plurality of diffusing elements located along the quarter and the vamp of the upper on the side of the upper that is along the outside of the user's foot.

14. A shoe according to claim 11 wherein the front face of the diffusing element is convex.

15. A shoe according to claim 14 wherein the diffusing element contains a pocket which opens out of its back face but not the front face, and the light source is in the pocket.

16. A shoe according to claim 14 wherein the front face of the diffusing element is generally elliptical in its peripheral configuration.

17. A shoe according to claim 11 wherein the diffusing element contains a pocket which opens out of its back face but not the front face; and the light source is in the pocket.

18. A shoe according to claim 11 wherein the pyramidal shapes are projections which are directed away from the front face, and the pyramidal shapes of any row are offset from the pyramidal shapes of the adjacent row or rows.

19. A shoe according to claim 11 wherein the diffusing element has a flange which projects beyond the array of pyramidal shapes formed by the facets and underlies the upper, and the diffusing element is attached to the upper by stitching which passes through the flange of the diffusing element and the upper.

20. In a shoe having an exposed surface, a diffusing element located along and visible at the exposed surface, the diffusing element being formed from a generally transparent material that is flexible and resilient, the diffusing element having a smooth front face that is presented outwardly and is exposed and a back face that is located behind the front face, the back face being formed from a multitude of facets arranged at angles with respect to each other to create an array of pyramidal shapes that are organized into side-by-side rows; and a light source carried by the shoe and positioned to illuminate the back face of the diffusing element.

21. The combination according to claim 20 wherein the diffusing element contains a pocket which opens out of fits back face but not the front face, and the light source is in the pocket.

22. The combination according to claim 21 wherein the shoe has an outsole and an upper attached to the outsole; and wherein the diffusing element and the light source are in the outsole.

23. The combination according to claim 20 wherein the pyramidal shapes are projections which are directed away from the front face, and the pyramidal shapes of any row are offset from the pyramidal shapes of the adjacent row or rows.

24. The combination according to claim 20 wherein the diffusing element has a flange which projects beyond the array of projections created by the facets, and is thinner than the remainder of the diffusing element.

* * * * *

UNITED STATES PATENT AND TRADEMARK OFFICE

CERTIFICATE OF CORRECTION

PATENT NO : 5,930,921

DATED : August 3, 1999

INVENTOR(S) : Howard Sorofman and Robert J. Armey

It is certified that error appears in the above-identified patent and that said Letters Patent is hereby corrected as shown below:

Col. 6, line 42
replace ""claim wherein""
with ----claim 9 wherein ----.

Signed and Sealed this

Seventeenth Day of October, 2000

*Attest:*

Q. TODD DICKINSON

*Attesting Officer*

*Director of Patents and Trademarks*